US005927212A

United States Patent [19]

Huang

[11] Patent Number: 5,927,212

[45] Date of Patent: Jul. 27, 1999

[54] TABLE WITH FOLDING LEAVES

[75] Inventor: Chun Te Huang, Kaoshiung-Hsien, Taiwan

[73] Assignee: Latitude Tree Furniture Sdn. Bhd., Malaysia

[21] Appl. No.: 08/956,901

[22] Filed: Oct. 23, 1997

[51] Int. Cl.[6] ..... A47B 1/03

[52] U.S. Cl. ..... 108/86; 108/83

[58] Field of Search ..... 108/86, 83, 88, 108/84

[56] References Cited

U.S. PATENT DOCUMENTS

| | | | |
|---|---|---|---|
| 710,376 | 9/1902 | Smith | 108/86 |
| 2,548,469 | 4/1951 | De Gaal | 108/83 |
| 4,553,485 | 11/1985 | Lee | 108/86 |
| 4,794,869 | 1/1989 | Chiu | 108/86 |
| 5,577,450 | 11/1996 | Huang | 108/86 |

FOREIGN PATENT DOCUMENTS

| | | | |
|---|---|---|---|
| 155792 | 8/1956 | Sweden | 108/83 |

*Primary Examiner*—Jose V. Chen
*Attorney, Agent, or Firm*—Raymond Sun

[57] ABSTRACT

A table is provided having first and second side bars positioned generally parallel to and spaced-apart from each other. A first table end segment is secured to the first outer ends of the first and second side bars, and a second table end segment is secured to the second outer ends of the first and second side bars. First and second crossing bars are connected to and extend between the first and second side bars. A removable table segment is positioned between the first and second table end segments, the removable table segment having a first leaf and a second leaf, with the first leaf pivotally coupled to the first and second crossing bars. A storage space is defined by the first and second side bars and the first and second crossing bars. The first and second leaves may be folded against each other and stored in the storage space to reduce the overall size of the table.

14 Claims, 6 Drawing Sheets

TABLE WITH FOLDING LEAVES

BACKGROUND OF THE INVENTION

1. Field of the Invention

The present invention relates to tables, and in particular, to a table having foldable leaves or segments that can be folded and stored underneath the table top when it is desired to decrease the overall size of the table top.

2. Description of the Prior Art

It is well-known to provide tables with center segments that can be removed when it is desired to decrease the overall size of the table top. A common example is the dining table, which is usually made of wood and has one or two legs supporting the table top. The center part of these dining tables is provided with one or more removable segments sandwiched between two end segments. To decrease the overall size of the table top, the two end segments are pulled apart and the removable segment(s) removed. The end segments that form the table top are then pushed back together with a resulting smaller table top. When it is desired to increase the size of the table top, the two end segments are pulled apart again, the removable segment(s) placed between the end segments, and the end segments pushed back together to provide a larger table top.

These prior art tables suffer from the drawback that the user often needs to find a place to store the removed segments. The heavy weight of these wooden segments also makes it inconvenient to move these segments around the house while the user is in search for a temporary storage location. This inconvenience is greater where homes are small and storage space scarce.

Thus, there is still a need for a table which provides for convenient storage of foldable leaves or segments below the table top, which is stable in the reduced-size configuration, and which is easy to install and use.

SUMMARY OF THE DISCLOSURE

In order to accomplish the objects of the present invention, there is provided a table having first and second side bars positioned generally parallel to and spaced-apart from each other. A first table end segment is secured to the first outer ends of the first and second side bars, and a second table end segment is secured to the second outer ends of the first and second side bars. First and second crossing bars are connected to and extend between the first and second side bars. A removable table segment is positioned between the first and second table end segments, the removable table segment having a first leaf and a second leaf, with the first leaf pivotally coupled to the first and second crossing bars. A storage space is defined by the first and second side bars and the first and second crossing bars. The first and second leaves may be folded against each other and stored in the storage space to reduce the overall size of the table.

In one embodiment of the present invention, a support bar is connected between the first and second crossing bars, and the first and second leaves are hingedly connected to each other. The second leaf has a bottom surface which rests on the support bar, and the first leaf rests on the second leaf, when the removable table segment is stored under the table end segments.

In another embodiment of the present invention, the first leaf is pivotally coupled to the first crossing bar by a first rotatable joint assembly, and the first leaf is pivotally coupled to the second crossing bar by a second rotatable joint assembly. Each rotatable joint assembly includes a connector connected to a crossing bar, and an L-shaped latch connected to the first leaf and pivotally connected to the connector. Each L-shaped latch may include a first section and a second section that are perpendicular to each other, with the first section pivotally coupled to the connector and the second section connected to the first leaf.

In yet another embodiment of the present invention, the table of further includes a base support assembly that includes a a first end piece connected to the first crossing bar, a second end piece connected to the second crossing bar, a bottom panel having opposing ends that are connected to the first and second end pieces in a manner in which the bottom panel is spaced apart from and is positioned below the crossing bars, and a leg secured to the bottom panel.

In a further embodiment of the present invention, the first end segment has a first extension and the second end segment has a second extension that are provided longitudinally and spaced apart from each other below the end segments. Each side bar has an outer surface and a longitudinally-extending groove provided along the outer surfaces thereof for slidably receiving one of the first or second extensions.

In yet a further embodiment of the present invention, the first and second leaves each has a side wall, and the bottom surface of the first and second leaves each has a catch arrangement. Each side wall may be folded towards the bottom surfaces of the leaves and retained against the bottom surfaces by the catch arrangement when the removable table segment is stored under the first and second table end segments.

Thus, the table according to the present invention provides rotatable joint assemblies that enable a removable segment to be easily and conveniently folded and stored under the table top. The rotatable joint assemblies and the support bar together provide a stable support for the removable segment when it is stored. The operations required to store the removable segment, and to re-install it to achieve the maximize table top size, are simple and can carried out quickly.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices and mechanisms are omitted so as to not obscure the description of the present invention with unnecessary detail.

The present invention provides a table 10 that is equipped with a removable center segment 12 that can be easily and conveniently folded and stored under the end segments 16 and 18 of the table 10. A pair of rotatable joint assemblies are provided for allowing the removable center segment 12 to be folded and stored under the end segments 16 and 18.

One embodiment of the present invention is illustrated in FIGS. 1–5. The table 10 has one removable center segment 12 disposed between two end segments 16 and 18. The three segments 12, 16 and 18 are supported by a support frame assembly.

Figure 2:
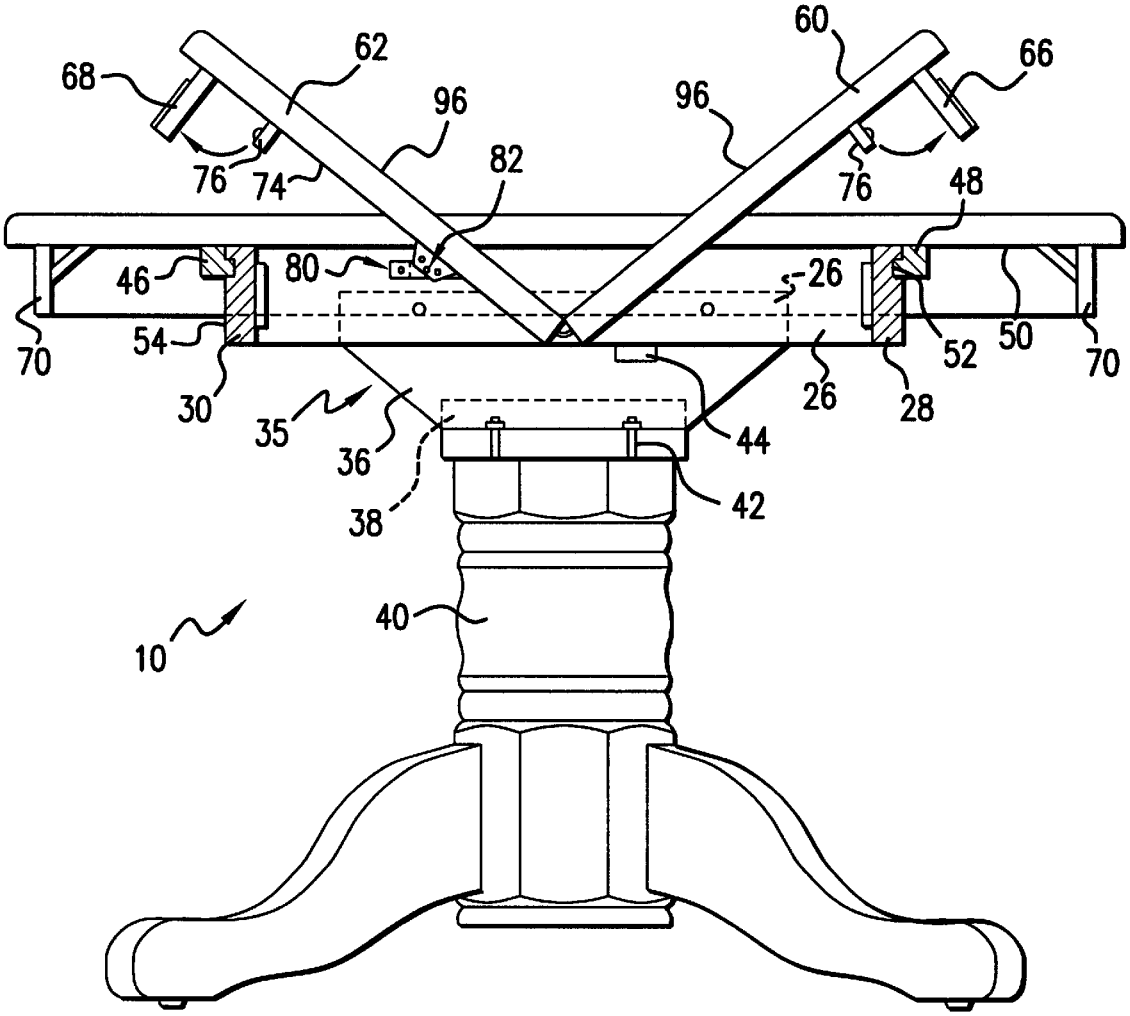
FIG. 2 is a side plan view of the table of FIG. 1 illustrating the folding of the leaves of one removable segment.
Figure 3:
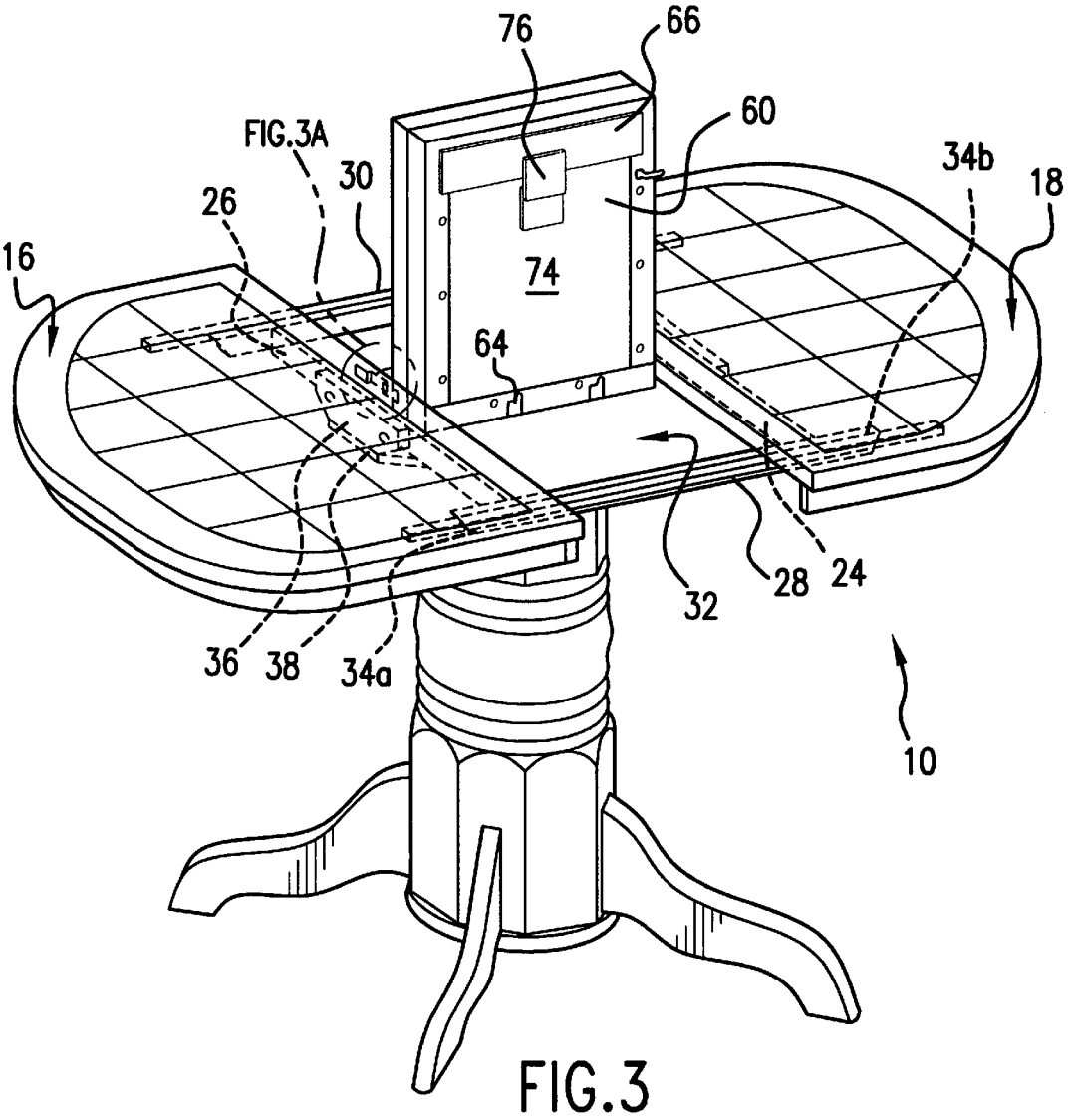
FIG. 3 is a perspective view of the table of FIG. 1 illustrating the folding of the leaves of one removable segment.
Figure 3A:
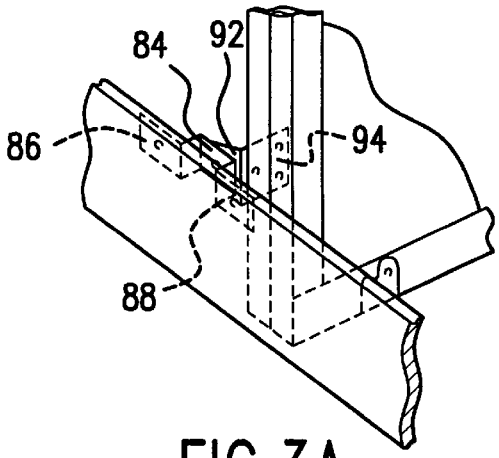
FIG. 3A is a sectional view taken from the region designated 3—3 in FIG. 3.

Referring more particularly to FIGS. 2 and 3, the support frame assembly includes two generally parallel crossing bars 24 and 26 that are connected to and that extend between a first side bar 28 and a second side bar 30. The side bars 28, 30 extend longitudinally and generally parallel to each other. The four bars 24, 26, 28 and 30 define a storage space 32 in which the removable segment 12 can be stored, as described hereinbelow. The crossing bars 24, 26 are connected to the side bars 28, 30 in a manner such that each side bar 28, 30 has opposing outer ends 34*a*, 34*b* that extend pass the location where the crossing bars 24, 26 are connected to the side bars 28, 30. The crossing bars 24, 26 are connected to the inside surfaces of the side bars 28, 30 according to any conventional connection technique, such as but not limited to the use of dovetail joints, screws and bolts, and others.

A base support assembly includes a U-shaped base mount 35 that includes a first end piece (not shown) connected to the first crossing bar 24 and a second end piece 36 connected to the second crossing bar 26 (see FIGS. 2 and 3). A bottom panel 38 has opposing ends that are connected to the bottom of the two end pieces 36. Thus, the bottom panel 38 is spaced apart from and is positioned below the crossing bars 24, 26 by the height of the end pieces 36. One leg 40 is connected under the bottom panel 38 by screws 42 or other conventional connection mechanisms, to support the table 10. The leg 40 may include a plurality of smaller support legs 43 extending therefrom to provide more stability to the table 10. A support bar 44, shown in FIGS. 2, 4 and 5, extends between and is connected under the two crossing bars 24 and 26, but above the bottom panel 38, at a position offset from the center of the crossing bars 24 and 26 in which it is closer to the first side bar 28.

End segment 16 is supported at one outer end 34*a* of both side bars 28, 30, and end segment 18 is supported at the other outer end 34*b*. Referring to FIG. 2, end segment 16 has a first generally L-shaped extension 46, and end segment 18 has a second generally L-shaped extension 48, provided longitudinally and spaced apart from each other on the bottom surface 50 of the end segments 16 and 18. Each side bar 28, 30 has a longitudinally-extending groove 52 provided on its outer surface 54 thereof, for receiving an L-shaped extension 46 or 48 therein. Thus, end segments 16 and 18 are slidably supported along the side bars 28, 30 by the mating engagement between the grooves 52 and the L-shaped extensions 46, 48. In this manner, the end segments 16, 18 may be slidably moved towards or away from each other by the sliding motion of the L-shaped extensions 46, 48 along the grooves 52, which act as rails, of the side bars 28, 30. Other conventional slidably supporting mechanisms and techniques can be provided without departing from the spirit and scope of the present invention.

Figure 5:
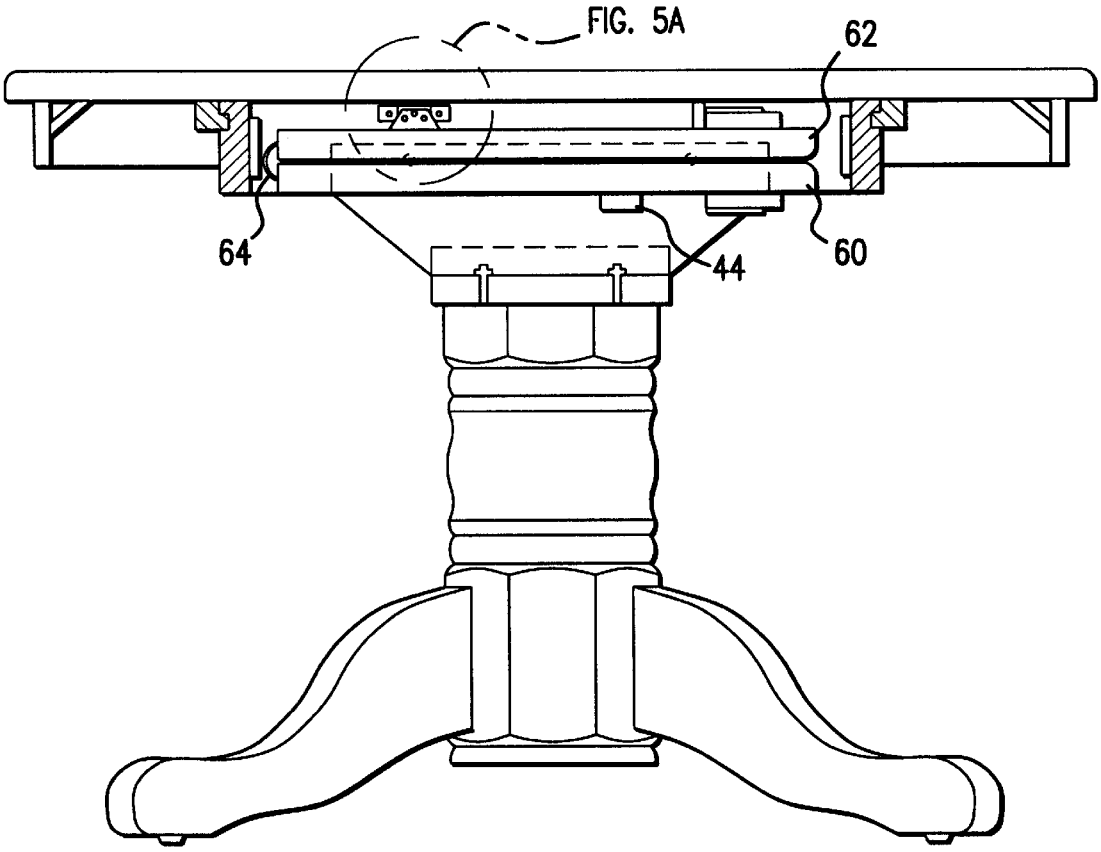
FIG. 5 is a cross-sectional side view of the table of FIG. 1 illustrating the leaves of the removable segment in their storage position.
Figure 5A:
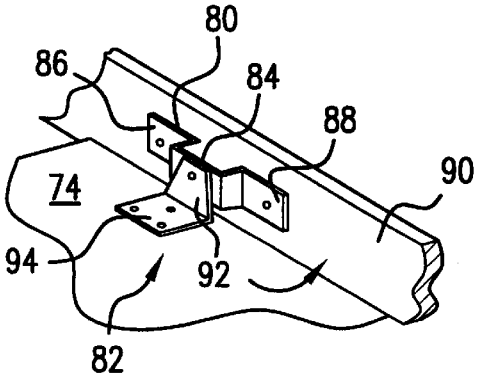
FIG. 5A is a sectional view taken from the region designated 5—5 in FIG. 5.

Removable segment 12 has two leaves 60 and 62 that can be folded about a plurality of hinge connections 64 provided at the center of the two leaves 60, 62 (see FIGS. 2, 3 and 5). Each leaf 60 and 62 has a side wall or apron 66 and 68, respectively. The side walls 66 and 68 are aligned with the side walls or aprons, such as 70 and 72, of the end segments 16 and 18 (see FIG. 1). Each side wall 66 and 68 is provided with a hinge mechanism, similar to the hinges 64, that allows it to be folded towards the bottom surface 74 of the respective leaf 60 and 62, respectively. A catch arrangement 76, such as but not limited to a hook or a latch mechanism, may be provided at the bottom surface 74 to hold each side wall 66 or 68 when the side wall is folded against the bottom surface 74. Folding the side walls 66 and 68 against the bottom surfaces 74 reduces the profile of the leaves 60 and 62 to facilitate storage of the removable segment 12 under the end segments 16, 18.

One leaf 62 is pivotally connected to the end segments 16 and 18 by two rotatable joint assemblies, one rotatable joint assembly connecting a crossing bar 24 to one side of the leaf 62, and another rotatable joint assembly connecting the other crossing bar 26 to the other side of the leaf 62. Referring to FIGS. 2, 3A, 5 and 5A, each rotatable joint assembly includes a connector 80 and an L-shaped latch 82. Each connector 80 has a U-shaped section 84 and a pair of opposing flanges 86 and 88 extending away from the U-shaped section 84. The opposing flanges 86, 88 are connected, by screws, rivets, or similar connection mechanisms, to an inside surface 90 of a crossing bar 24 or 26. Each L-shaped latch 82 has a first section 92 and a second section 94 that are perpendicular to each other. The first section 92 is rotatably connected, by screws, rivets, or similar rotatable connection mechanisms, to the bottom of U-shaped section 84 of one connector 80 to form a pivotable connection, and the second section 94 is connected, by screws, rivets, or similar connection mechanisms, to a bottom surface 74 of the leaf 62. Thus, the joint assemblies allow the L-shaped latch 82 to be rotated about its connection with the connector 80.

The U-shaped section 84 operates to separate, or to provide a space, between the inside surface 90 of the crossing bars 24 and 26 and the leaf 62, and can be omitted if desired. If the U-shaped section 84 is omitted, the L-shaped latch 82 can be pivotally connected directly to the inside surface 90.

Figure 1:
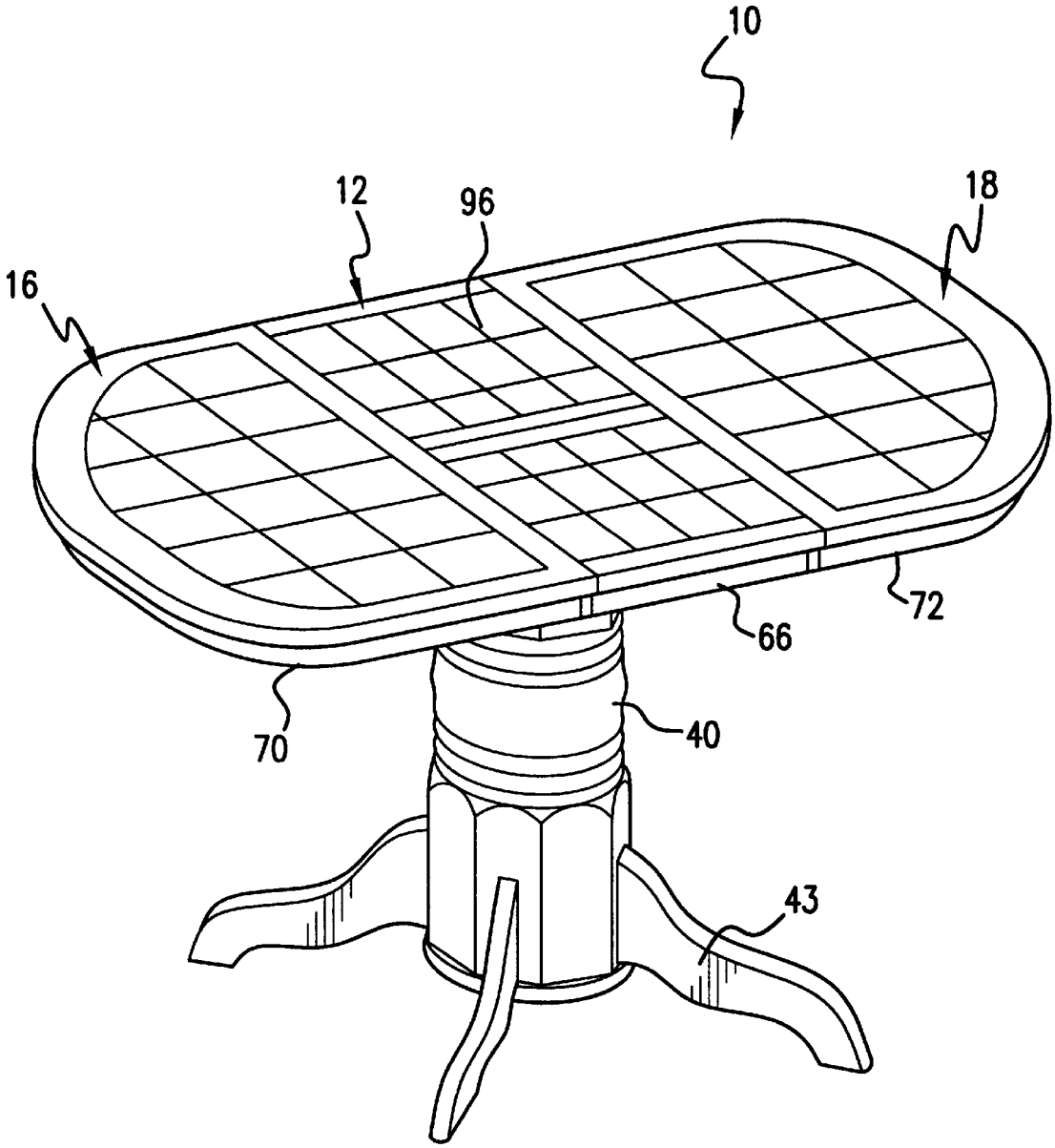
FIG. 1 is a perspective view of a table according to the present invention.
Figure 4:
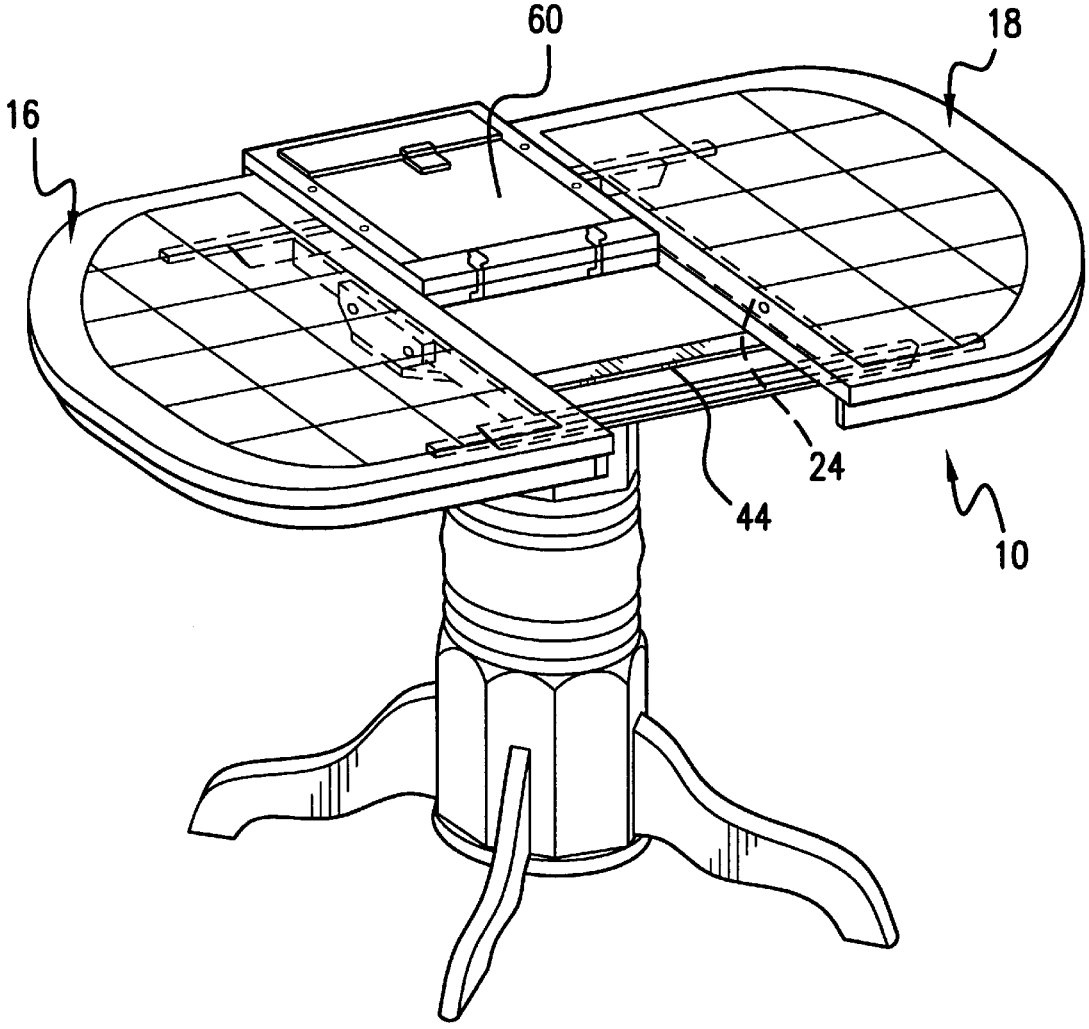
FIG. 4 is a perspective view of the table of FIG. 1 illustrating the leaves of the removable segment folded against each other.

The operation of the table 10 will now be described with reference to FIGS. 1–5. FIG. 1 illustrates the table 10 in its largest or maximum configuration where it is being used at its maximum size with the removable segment 12 in place between the end segments 16 and 18. To reduce the overall size of the table top, the removable segment 12 is removed. To do so, the end segments 16 and 18 are pulled away from the removable segment 12, and the leaves 60 and 62 folded about their hinge connections 64 to cause one leaf 60 to rest against the other leaf 62 (see FIGS. 2 and 3). The leaf 62 also pivots about the rotatable connections between the L-shaped latches 82 and the connectors 80 that support the leaf 62 between the crossing bars 24, 26. The bottom panel 38 is positioned below the crossing bars 24, 26 to provide sufficient clearance for the hinged portion of the folded leaves 60, 62 to pivot about the storage space 32. The side walls or aprons 66 and 68 are folded inwardly towards the bottom surface 74 and held in place by the catch arrangement 76. As shown in FIG. 4, the combined leaves 60, 62 may be folded down on the top of side bar 30, although this step is not necessary. However, FIG. 4 illustrates how the pivot defined by the L-shaped latches 82 and the connectors 80 is offset from the center of the crossing bars 24 and 26, as explained below.

The combined leaves 60, 62 are then pivoted about the rotatable connections between the L-shaped latches 82 and the connectors 80 to cause the combined leaves 60, 62 to be folded down on, and to rest on, the top of the support bar 44 (see FIG. 5). Since the pivot point defined by the rotatable connections between the L-shaped latches 82 and the connectors 80 is along the inside edges of one leaf 62, the pivot point is at a location that is offset from the center of the crossing bars 24, 26. This enables the combined leaves 60, 62 to be folded and pivoted into the storage space 32 without contacting or resting on the side bar 28.

Figure 6:
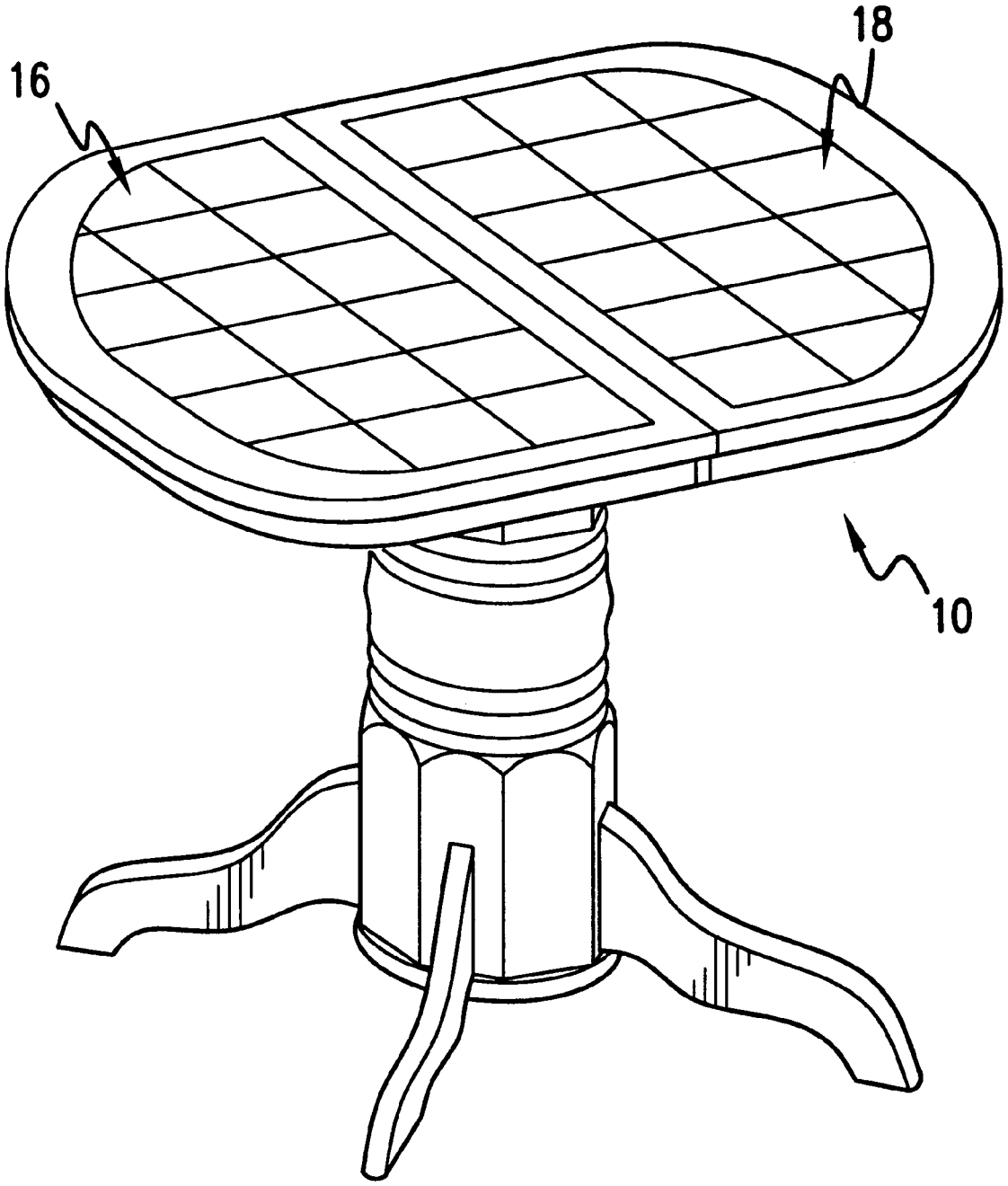
FIG. 6 is a perspective view of the table of FIG. 1 after the removable segment has been stored.

In this storage position, the bottom surface 74 of leaf 60 rests on the support bar 44, while the top surface 96 of the leaf 62 rests on top of the top surface 96 of the leaf 60. Thus, in this storage position, the combined leaves 60, 62 are supportably retained inside the storage space 32 by the support bar 44. In addition, the combined thickness of the two leaves 60, 62 is preferably less than the height of the crossing bars 24, 26 so that the two leaves 60, 62 fit entirely within the confines of the storage space 32 that is defined by the crossing bars 24, 26 and the side bars 28, 30, and below the top of these bars 24, 26, 28, 30, thereby allowing the leaves 60, 62 to be stored under the end segments 16, 18. The support bar 44 and the rotatable connections between the L-shaped latches 82 and the connectors 80 together provide a stable support system for holding and storing the removable segment 12 under the end segments 16, 18 of the table 10. The end segments 16 and 18 are now pushed back towards each other to provide a smaller table top in the reduced configuration (see FIG. 6).

Locks (not shown) can also be provided on the bottom surfaces of the removable segment 12 and the end segments to lock two adjacent segments 16, 18 together in either the maximum or reduced configurations, thereby preventing the adjacent segments from being unintentionally separated during use.

To re-install the removable segment, the lock (if provided) can be unlocked, and the end segments 16 and 18 are pulled away from each other. The combined leaves 60, 62 of the removable segment 12 are then rotated about the rotatable connections between the L-shaped latches 82 and the connectors 80 so that the bottom surface 74 of leaf 62 rests on the side bar 30. The other leaf 60 is then unfolded about the hinge connections 64 and its bottom surface 74 rested on the side bar 28. The end segments 16 and 18 are then pushed towards the re-installed removable segment 12, and the locks redeployed to hold the segments 12, 16, 18 securely together.

Thus, the table 10 according to the present invention provides rotatable joint assemblies that enable a removable segment 12 to be easily and conveniently folded and stored under the table top. The rotatable joint assemblies allow the leaves 60, 62 of the removable segment 12 to be folded and stored under the top of the end segments 16, 18. The rotatable joint assemblies and the support bar 44 together provide a stable support for the removable segment 12 when it is stored.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A table comprising:

first and second side bars positioned generally parallel to and spaced-apart from each other, each side bar having opposing first and second outer ends;

a first table end segment secured to the first outer ends of the first and second side bars;

a second table end segment secured to the second outer ends of the first and second side bars;

first and second crossing bars connected to and extending between the first and second side bars;

a removable table segment positioned between the first and second table end segments, the removable table segment having a first leaf and a second leaf, with the first leaf pivotally coupled to the first and second crossing bars; and a storage space defined by the first and second side bars and the first and second crossing bars;

wherein the first and second leaves may be folded against each other and stored in the storage space to reduce the overall size of the table the first and second leaves each has a side wall hingedly connected therewith, and the bottom surface of the first and second leaves each has a catch arrangement, and wherein each side wall is folded towards the bottom surfaces of the leaves and retained against the bottom surface by engagement with the catch arrangement when the removable table segment is stored under the first and second table end segments.

2. The table of claim 1, further comprising a support bar connected between the first and second crossing bars.

3. The table of claim 2, wherein the first and second leaves are hingedly connected to each other.

4. The table of claim 3, wherein the second leaf has a bottom surface which rests on the support bar, and the first leaf rests on the second leaf when the removable table segment is stored under the table end segments.

5. The table of claim 2, wherein the first leaf is pivotally coupled to the first crossing bar by a first rotatable joint assembly, and the first leaf is pivotally coupled to the second crossing bar by a second rotatable joint assembly.

6. The table of claim 5, wherein each rotatable joint assembly includes a connector connected to a crossing bar, and an L-shaped latch connected to the first leaf and pivotally connected to the connector.

7. The table of claim 6, wherein each L-shaped latch has a first section and a second section that are perpendicular to each other, with the first section pivotally coupled to the connector and the second section connected to the first leaf.

8. The table of claim 1, further including a base support assembly that includes:

a first end piece connected to the first crossing bar;

a second end piece connected to the second crossing bar;

a bottom panel having opposing ends that are connected to the first and second end pieces in a manner in which the bottom panel is spaced apart from and is positioned below the crossing bars; and a leg secured to the bottom panel.

9. The table of claim 1, wherein the first end segment has a first extension and the second end segment has a second extension that are provided longitudinally and spaced apart from each other below the end segments, and wherein each side bar has an outer surface and a longitudinally-extending groove provided along the outer surfaces thereof for slidably receiving one of the first or second extensions.

10. A table comprising:

first and second side bars positioned generally parallel to and spaced-apart from each other, each side bar having opposing first and second outer ends;

a first table end segment secured to the first outer ends of the first and second side bars;

a second table end segment secured to the second outer ends of the first and second side bars;

first and second crossing bars connected to and extending between the first and second side bars;

a support bar connected between the first and second crossing bars;

a removable table segment positioned between the first and second table end segments, the removable table segment having a first leaf and a second leaf pivotally coupled to each other, with the second leaf having a bottom surface;

means for pivotally coupling the first leaf to the first and second crossing bars; and a storage space defined by the first and second side bars and the first and second crossing bars;

wherein the first and second leaves may be folded against each other and stored in the storage space, with the bottom surface of the second leaf resting on the support bar, and with the first leaf resting on the second leaf the first and second leaves each has a side wall hingedly connected therewith, and the bottom surface of the first and second leaves each has a catch arrangement, and wherein each side wall is folded towards the bottom surfaces of the leaves and retained against the bottom surface by engagement with the catch arrangement when the removable table segment is stored under the first and second table end segments.

11. The table of claim 10, wherein the pivotally coupling means comprises a first rotatable joint assembly for coupling the first leaf to the first crossing bar, and a second rotatable joint assembly for coupling the first leaf to the second crossing bar.

12. The table of claim 11, wherein each rotatable joint assembly includes a connector connected to a crossing bar, and an L-shaped latch connected to the first leaf and pivotally connected to the connector.

13. The table of claim 12, wherein each L-shaped latch has a first section and a second section that are perpendicular to each other, with the first section pivotally coupled to the connector and the second section connected to the first leaf.

14. The table of claim 10, further including a base support assembly that includes:

a first end piece connected to the first crossing bar;

a second end piece connected to the second crossing bar;

a bottom panel having opposing ends that are connected to the first and second end pieces in a manner in which the bottom panel is spaced apart from and is positioned below the crossing bars; and a leg secured to the bottom panel.

* * * * *